US010456940B2

(12) United States Patent
Herrero et al.

(10) Patent No.: US 10,456,940 B2
(45) Date of Patent: Oct. 29, 2019

(54) NOTCHING TOOL, USE AND METHOD

(71) Applicant: Maquinaria GEKA, S.A., Oiartzun (Guipúzcoa) (ES)

(72) Inventors: Alberto José Herrero, Oiartzun (ES); Mikel Pardavila, Oiartzun (ES)

(73) Assignee: Maquinaria Geka, S.A., Oiartzun (Guipúzcoa) (ES)

( * ) Notice: Subject to any disclaimer, the term of this patent is extended or adjusted under 35 U.S.C. 154(b) by 0 days.

(21) Appl. No.: 15/622,403

(22) Filed: Jun. 14, 2017

(65) Prior Publication Data

US 2017/0361482 A1 Dec. 21, 2017

(30) Foreign Application Priority Data

Jun. 15, 2016 (EP) ..... 16382277

(51) Int. Cl.

| | |
|---|---|
| ***B26D 3/14*** | (2006.01) |
| ***B21D 28/22*** | (2006.01) |
| ***B21D 28/26*** | (2006.01) |
| ***B21D 28/34*** | (2006.01) |

(52) U.S. Cl.

CPC ..... *B26D 3/14* (2013.01); *B21D 28/22* (2013.01); *B21D 28/26* (2013.01); *B21D 28/34* (2013.01)

(58) Field of Classification Search

CPC ... Y10T 83/944; Y10T 83/942; Y10T 83/943; B21D 28/22; B21D 28/28; B21D 28/26; B26D 3/14

See application file for complete search history.

(56) References Cited

U.S. PATENT DOCUMENTS

| | | | | |
|---|---|---|---|---|
| 1,874,036 A * | 8/1932 | Gray | B23D 35/002 | 83/688 |
| 2,279,390 A | 4/1942 | Ekstedt et al. | | |
| 3,073,195 A * | 1/1963 | Koster | B23D 21/02 | 83/191 |
| 3,120,143 A * | 2/1964 | Kreider | B23D 21/02 | 30/366 |
| 3,724,305 A * | 4/1973 | Kondo | B21D 28/16 | 83/14 |
| 3,752,027 A * | 8/1973 | Gerber | B26D 3/12 | 83/613 |
| 4,307,499 A * | 12/1981 | Isella | A44B 19/58 | 29/33.2 |

(Continued)

OTHER PUBLICATIONS

Extended European Search Report dated Nov. 30, 2016 re: Application No. No. 16382277.8; pp. 1-10; citing: U.S. Pat. No. 2,279,390 A.

*Primary Examiner* — Andrea L Wellington
*Assistant Examiner* — Fernando A Ayala
(74) *Attorney, Agent, or Firm* — The Webb Law Firm

(57) ABSTRACT

A notching tool for notching a workpiece, the notching tool having a notching punch and a die having an inner surface. The notching punch includes first and second punch portions, the first punch portion has a punch plane intended to hit the workpiece in a notching operation. The second punch portion protrudes from the punch plane in a direction which is substantially perpendicular to the punch plane, and is intended to contact the inner surface of the die when the notching punch hits the workpiece. The disclosure further provides a use of this notching tool and a method of notching which involves the operation of such a notching tool.

5 Claims, 2 Drawing Sheets

(56) References Cited

U.S. PATENT DOCUMENTS

| | | | | | |
|---|---|---|---|---|---|
| 4,739,687 | A * | 4/1988 | Wanner | B21D 28/34 | 83/688 |
| 5,163,350 | A * | 11/1992 | Groswith, III | B26F 1/04 | 83/549 |
| 5,243,887 | A * | 9/1993 | Bonge, Jr. | B26F 1/14 | 83/467.1 |
| 6,938,542 | B1 * | 9/2005 | Ho | B44B 5/0023 | 101/3.1 |
| 9,381,559 | B2 * | 7/2016 | Matsumura | B21D 28/02 | |

* cited by examiner

NOTCHING TOOL, USE AND METHOD

CROSS REFERENCE TO RELATED APPLICATIONS

This application is related to and claims the benefit of Spanish Patent Application No. EP16382277.8, filed on Jun. 15, 2016, the contents of which are herein incorporated by reference in their entirety.

TECHNICAL FIELD

This disclosure belongs to the field of punching machines, and the devices used in these machines.

BACKGROUND

Conventional punching involves hitting a workpiece between a punch and a die, in such a way that the punch perforates the piece, and enters the die, creating a hole in said piece claim If said hole is closed, i.e., is surrounded in its total lateral contour by material of the workpiece, forces and moment are balanced regarding the reaction forces distribution in the die. The punch only bears the punching force in the punching axis, but no appreciable moment is created, neither other forces are born by the punch.

However, sometimes holes are open, and they are called notches. Notching is a more difficult operation than conventional punching, as in these operations, forces and moment are not balanced. This lack of balance may produce some damage in the punch press internal parts, due to the high magnitude of reaction forces and the fact that punch presses are not adapted to bear such forces.

SUMMARY

This problem is solved by providing a notching tool comprising a notching punch and a die comprising an inner surface, wherein the notching punch comprises a first punch portion with a punch plane, the punch plane being intended to hit the workpiece in a notching operation; and a second punch portion protruding from the punch plane in a direction which is substantially perpendicular to the punch plane, the second punch portion being intended to contact the inner surface of the die when the notching punch hits the workpiece.

The problem is further solved by providing the above notching tool and use of such a notching tool wherein the first punch portion has a height $h_{fp}$; the second punch portion has a height $h_{sp}$ and a yield shear strength $\tau_{sp}$; the workpiece has an edge, a height h, a Poisson's ratio v, an ultimate shear strength $\tau_{USS}$ and a notching section which takes up a surface $S_{notch}$ in the workpiece and has a lateral surface $S_{lat}$; the notching operation requiring a force $F_{shear}$ to remove the notching section from the workpiece; and wherein the height of the second punch portion of the punch $h_{sp}$ is greater than h.

The problem is further solved by providing a method of notching a workpiece by means of the above described notching tool, wherein the method includes the following steps: providing a workpiece for being notched, the workpiece having an edge, a height h, a Poisson's ratio v and a notching section which takes up a surface $S_{notch}$ in the workpiece, and has a lateral surface $S_{lat}$; providing the notching tool, the second punch portion having a height $h_{sp}$ and an ultimate shear strength $\tau_{sp}$, the height of the notching punch $h_{sp}$ being greater than h; performing a notching operation requiring a force $F_{shear}$ to remove the notching section from the workpiece, and causing a shear stress $\tau$ in the lateral surface $S_{lat}$ of the notching section. Preferred embodiments of the disclosure are defined in the dependent claims.

In a first inventive aspect, the disclosure provides a notching tool for notching a workpiece, the notching tool comprising a notching punch and a die comprising an inner surface, wherein the notching punch comprises a first punch portion with a punch plane, the punch plane being intended to hit the workpiece in a notching operation; and a second punch portion protruding from the punch plane in a direction which is substantially perpendicular to the punch plane, the second punch portion being intended to contact the inner surface of the die when the notching punch hits the workpiece.

This embodiment is able to endure some reaction forces which are specific from the notching operations. The second punch portion which protrudes from the first punch portion in a direction which is perpendicular to the punch plane enters the die first and receives a reaction force.

In a particular embodiment, the second punch portion protrudes at least 3 mm from the punch plane of the first punch portion.

This embodiment is able to enter the die before the notching operation is performed if the workpiece is not very thick.

In a particular embodiment, the first punch portion comprises a first lateral edge and the second punch portion comprises a second lateral edge, in such a way that there is a continuous and derivable surface which is common both to a portion of the first lateral edge and to a portion of the second lateral edge.

This arrangement makes it possible that both the first punch portion and the second punch portion hit the die at the same time.

In a second inventive aspect, the disclosure provides a use of a notching tool according to the first inventive aspect in the notching operation of a workpiece, the first punch portion having a height $h_{fp}$ the second punch portion having a height $h_{sp}$ and a yield shear strength $\tau_{sp}$;

the workpiece having an edge, a height h, a Poisson's ratio v, an ultimate shear strength $\tau_{USS}$ and a notching section which takes up a surface $S_{notch}$ in the workpiece and has a lateral surface $S_{lat}$;

the notching operation requiring a force $F_{shear}$ to remove the notching section from the workpiece;

wherein the height of the second punch portion $h_{sp}$ is greater than h.

The height $h_{fp}$ of the first punch portion depends on the technical features of the punching machine where the notching tool is to be installed. There are standard sizes, but the disclosure is able to be used in every punching machine, so any limitation in this sense would be meaningless.

In this use of the notching tool, the height of the second punch portion allows the entering of the punch in the die before the notching operation starts. This fact provides a better stability of the notching tool when bearing the forces associated to this operation.

In a particular embodiment, the second punch portion has an effective surface $S_{sp}$ which is greater than $S_{sp\text{-}min}$, wherein $$S_{sp-min} = \frac{F_X \cdot (h_{fp} + h/2) - M_Y}{(h_{fp} + h_{sp}) \cdot \tau_{sp}}$$

$$M_Y = \int_{S_{lat}} \tau_{USS} \cdot h \cdot (x_p - x) ds$$

$$F_X = \int_{S_{lat}} -v \cdot h \cdot \frac{F_{shear}}{S_{notch}} ds$$

wherein $x_p$ is the distance between the edge of the workpiece and the projection of the centre of mass of the first punch portion over the surface of the workpiece; and x is the distance between the integration parameter ds and the edge of the workpiece.

This particular embodiment presents a second punch portion the size of which is calculated to bear the forces and moments which are generated in the notching operation.

In a third inventive aspect, the disclosure provides a method of notching a workpiece by means of a notching tool according to the first inventive aspect, the method comprising the steps of providing a workpiece for being notched, the workpiece having an edge, a height h, a Poisson's ratio v and a notching section which takes up a surface $S_{notch}$ in the workpiece, and has a lateral surface $S_{lat}$;

providing a notching tool according to the first inventive aspect, the second punch portion having a height $h_{sp}$ and an ultimate shear strength $\tau_{sp}$, the height of the notching punch $h_{sp}$ being greater than h;

performing a notching operation requiring a force $F_{shear}$ to remove the notching section from the workpiece, and causing a shear stress $\tau$ in the lateral surface $S_{lat}$ of the notching section.

In this notching method, the height of the second punch portion allows the entering of the punch in the die before the notching operation starts. This fact provides a better stability of the notching tool when bearing the forces associated to this operation.

In a particular embodiment, the second punch portion has an effective surface $S_{sp}$ which is greater than $S_{sp-min}$, wherein $$S_{sp-min} = \frac{F_X \cdot (h_{fp} + h/2) - M_Y}{(h_{fp} + h_{sp}) \cdot \tau_{sp}}$$

$$M_Y = \int_{S_{lat}} \tau_{USS} \cdot h \cdot (x_p - x) ds$$

$$F_X = \int_{S_{lat}} -v \cdot h \cdot \frac{F_{shear}}{S_{notch}} ds$$

wherein $x_p$ is the distance between the edge of the workpiece and the projection of the centre of mass of the first punch portion over the surface of the workpiece.

This particular embodiment presents a second punch portion the size of which is calculated to bear the forces and moments which are generated in the notching operation.

BRIEF DESCRIPTION OF THE DRAWINGS

To complete the description and in order to provide for a better understanding of the disclosure, a set of drawings is provided. Said drawings form an integral part of the description and illustrate an embodiment of the disclosure, which should not be interpreted as restricting the scope of the disclosure, but just as an example of how the disclosure can be carried out. The drawings comprise the following figures.

DETAILED DESCRIPTION OF THE DRAWINGS

Figure 1A:
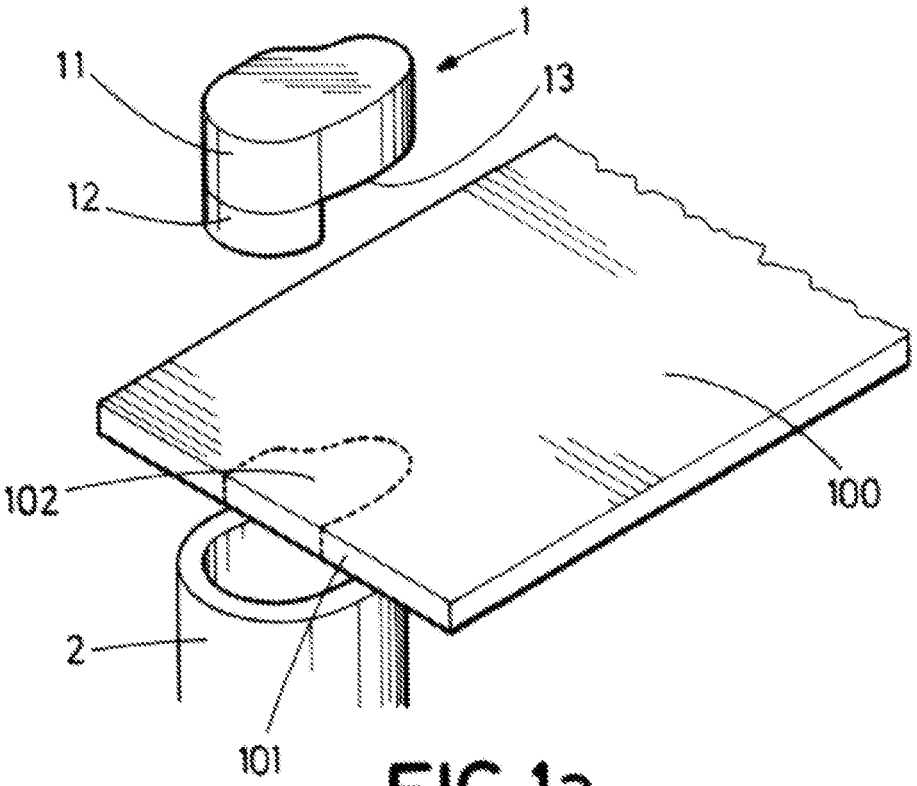
FIGS. 1*a* and 1*b* show a scheme of a notching operation with a notching punch according to the disclosure.
Figure 1B:
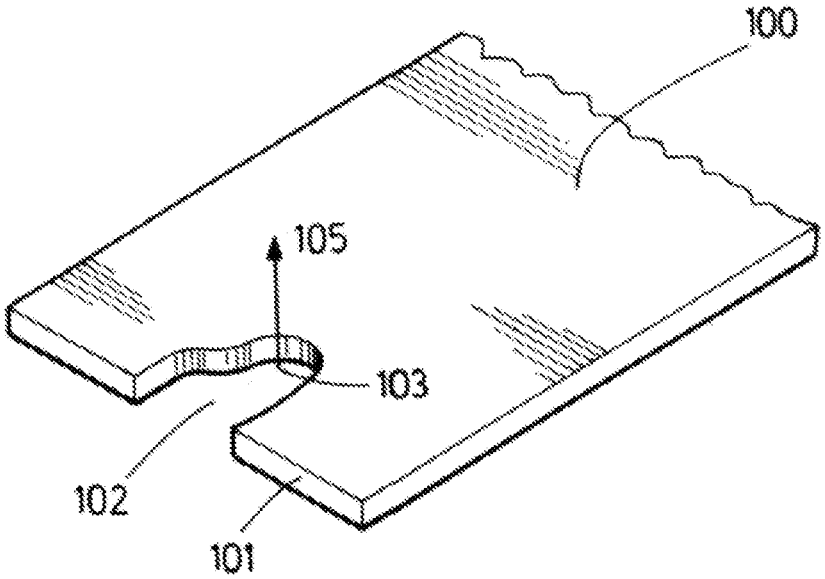

FIGS. 1*a* and 1*b* show a scheme of a notching operation. FIG. 1*a* shows a notching tool (10) according to the disclosure and a workpiece (100) with an edge (101).

The notching tool (10) comprises a notching punch (1) and a die (2) comprising an inner surface (21), wherein the notching punch (1) comprises a first punch portion (11) with a punch plane (13), the punch plane (13) being intended to hit the workpiece (100) in a notching operation; and the notching punch (1) further comprises a second punch portion (12) protruding from the punch plane (13) in a direction which is substantially perpendicular to the punch plane (13), the second punch portion (12) being intended to contact the inner surface (21) of the die (2) when the notching punch (1) hits the workpiece (100).

In the notching operation, the notching punch (1) hits the workpiece (100) against the die (2). A punching press also intervenes in the notching operation, but this element is not shown in these figures for a clearer view of the disclosure, and because the disclosure may be used with any punching press. The workpiece comprises a notching section (102), which is the section that is to be notched in the notching operation. The notching section (102) comprises part of the edge (101) of the workpiece (100).

FIG. 1*b* shows a distribution of reaction forces in the workpiece (100) which has suffered the notching operation due to the shear forces applied on it. According to classic mechanics, the effect of this distribution of reaction forces is equivalent to the effect of a result reaction force (105) placed in a result application point (103). In the case of punching a close hole, the result application point (103) would be placed in the centre of mass of the notching section (102). But in notching operations, the part of the notching section (102) which belonged to the edge (101) of the workpiece (100) does not produce any shear forces, unbalancing the position of the result reaction force (105), thus creating a moment. As a consequence, the application point (103) is not placed in the centre of mass of the notching section (102). As the notching punch (1) comprises a surface that extends beyond the notching section (102), further away from the edge (101) of the workpiece (100), the result reaction force (105) is not applied in the centre of mass of the notching punch (1) either.

Figure 2:
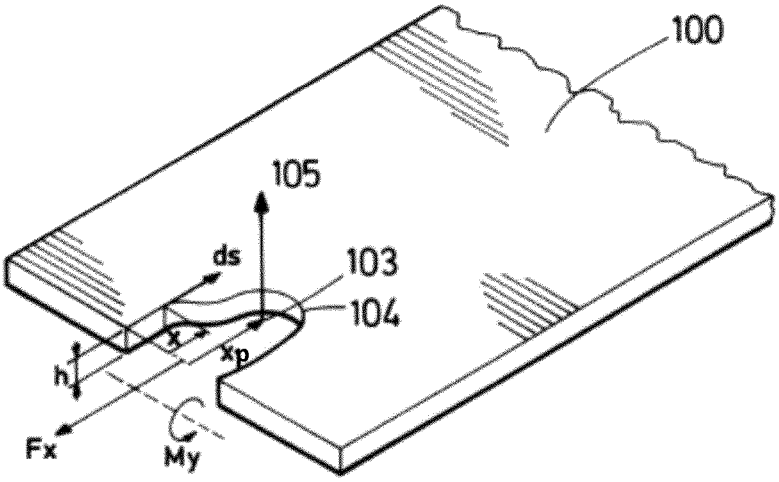
FIG. 2 shows a scheme of forces and moments which intervene in the notching operation with a notching punch according to the disclosure.

FIG. 2 shows the effect of this result reaction force (105) being applied on the result application point (103).

As this result reaction force (105) is not applied in the centre of mass of the notching punch (1), it produces a reaction moment in the notching punch (1), which may be calculated according to known formulae:

$$M_Y = \int_{S_{lat}} \tau_{uss} \cdot h \cdot (x_p - x) ds$$

wherein $\tau_{uss}$ is the ultimate shear stress of the workpiece;

h is the height of the workpiece;

$x_p$ is the distance between the result application point (103) and the edge (101) of the workpiece (100);

x is the distance between the integration parameter ds and the edge (101) of the workpiece (100); and $S_{lat}$ is the lateral surface (104) of the notching section.

Further, due to the recovery elastic forces, the workpiece also exerts a force $F_X$ against the notching punch in a direction which is perpendicular to the edge (101) of the workpiece (100), which can be calculated with the Hooke Law, applied to the notching case:

$$F_X = \int_{S_{lat}} -v \cdot h \cdot \frac{F_{shear}}{S_{notch}} ds$$

wherein v is the Poisson modulus of the workpiece;

$F_{shear}$ is the force needed to remove the notching section from the workpiece; and $S_{notch}$ is the surface that the notching section takes up in the workpiece.

This moment $M_Y$ and this force $F_X$ are generated in every notching operation. They apply to known notching punches and to the notching punch (1) according to the disclosure. The second punch portion (12) of the disclosure advantageously provides a way of reacting against this moment $M_Y$ and this force $F_X$.

The second punch portion (12), because of being part of the notching punch (1), receives this moment $M_Y$ and this force $F_X$, but when the notching punch (1) hits the workpiece (100), the second punch portion (12) is already inside the die (2), so it can bear the moment $M_Y$ and the force $F_X$ against the die (2). The die reaction force $R_X$ which balances the $F_X$ is applied in a different plane from this $F_X$, both forces causes a second moment.

Figure 3:
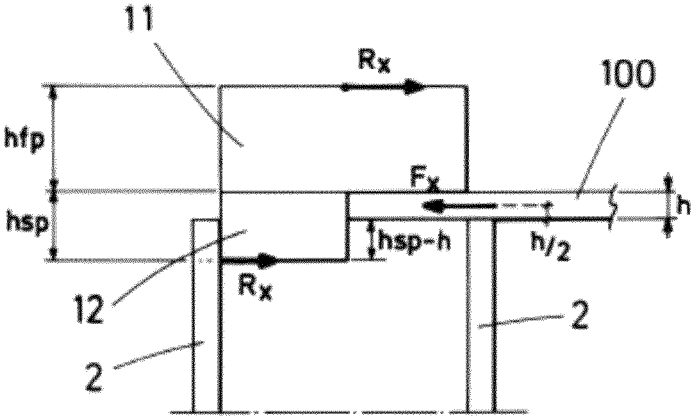
FIG. 3 shows a front cross section view of a scheme of forces and moments which intervene in the notching operation with a notching punch according to the disclosure.

As shown in FIG. 3, setting the moment equilibrium equations, reaction force $R_X$ would be:

$$R_X = \frac{F_X \cdot (h_{fp} + h/2) - M_Y}{h_{fp} + h_{sp}}$$

wherein $h_{fp}$ is the height of the first punch portion; and $h_{sp}$ is the height of the second punch portion.

If the second punch portion wants to bear all the forces and moments generated in the notching operation, it should have at least an effective surface $S_{sp}$ enough to bear the shear stress caused by this reaction force $R_X$. This effective surface $S_{sp}$ of the second punch portion is the projection of the second punch portion onto the punch plane. In particular embodiments, this effective surface is parallel to the punch plane, but in other embodiments, Accordingly, the minimum effective surface would be $$S_{sp-min} = \frac{R_X}{\tau_{sp}} = \frac{F_X \cdot (h_{fp} + h/2) - M_Y}{(h_{fp} + h_{sp}) \cdot \tau_{sp}}$$

However, it is not strictly necessary for every particular embodiment of the second punch portion to have at least this minimum effective surface, this requirement is only present in preferred embodiments.

Further, in the use of this notching punch, the height of the second punch portion $h_{sp}$ is greater than h.

Figure 4:
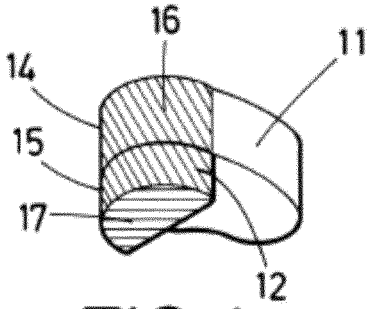
FIG. 4 shows a different view of a notching tool according to the disclosure.

FIG. 4 shows a different view of a notching tool (10) according to the disclosure. In this figure, the die is not shown, since the perspective view is from the bottom part of the notching tool (10).

In this figure, a first lateral edge (14) may be seen in the first punch portion (11), and a second lateral edge (15) may be seen in the second punch portion (12). These first and second lateral edges (14, 15) are part of the same continuous and derivable surface (16), which is thus common to part of the first punch portion (11) and to part of the second punch portion (12). This arrangement makes it possible for the first and second punch portions (11, 12) to hit the die (2) substantially at the same time, thus improving the performance of this embodiment of the notching tool.

Also in this figure, the bottom surface of the second punch portion (12) is seen. The bottom surface should be understood as the surface of the second punch portion (12) that is farther from the first punch portion (11). This bottom surface is usually a surface which is parallel to the punch plane (13). This surface usually coincides with the effective surface (17) $S_{sp}$ of the second punch portion (12). The effective surface (17) $S_{sp}$ of the second punch portion (12) is the projection of the second punch portion (12) over the punch plane (13). If the second punch portion (12) is a cylinder, in the sense that the cross section is constant, the bottom surface and the effective surface (17) $S_{sp}$ are the same, as in the case of the present figure. Despite this is the usual arrangement, in other embodiments the effective surface (17) $S_{sp}$ does not coincide with the bottom surface.

In this text, the term "comprises" and its derivations (such as "comprising", etc.) should not be understood in an excluding sense, that is, these terms should not be interpreted as excluding the possibility that what is described and defined may include further elements, steps, etc.

The disclosure is obviously not limited to the specific embodiments described herein, but also encompasses any variations that may be considered by any person skilled in the art (for example, as regards the choice of materials, dimensions, components, configuration, etc.), within the general scope of the disclosure.

The invention claimed is:

1. A notching tool for notching a workpiece, the notching tool comprising a notching punch and a die comprising an inner surface, the notching punch comprising:

a first punch portion with a punch plane, the punch plane being intended to hit the workpiece in a notching operation; and a second punch portion protruding from the punch plane in a direction which is substantially perpendicular to the punch plane, the second punch portion being intended to contact the inner surface of the die when the notching punch hits the workpiece;

the first punch portion having a height $h_{fp}$;

the second punch portion having a height $h_{sp}$ and a yield shear strength $T_{sp}$;

the workpiece having opposing outer surfaces, an edge having a height h, a Poisson's ratio v, an ultimate shear strength $T_{uss}$, and a notching section which takes up a surface $S_{notch}$ in the workpiece and has a lateral surface $S_{lat}$;

the notching operation requiring a force $F_{shear}$ to remove the notching section from the workpiece, and the height of the second punch portion of the punch $h_{sp}$ is greater than h, wherein the second punch portion has an effective surface $S_{sp}$ which is greater than $S_{sp\text{-}min}$, wherein $$S_{sp-min} = \frac{F_X \cdot (h_{fp} + h/2) - M_Y}{(h_{fp} + h_{sp}) \cdot \tau_{sp}}$$

$$M_Y = \int_{S_{lat}} \tau_{USS} \cdot h \cdot (x_p - x) ds$$

$$F_X = \int_{S_{lat}} -v \cdot h \cdot \frac{F_{shear}}{S_{notch}} ds$$

wherein $x_p$ is the distance between the edge of the workpiece and a projection of a center of mass of the first punch portion onto one of the opposing surfaces of the workpiece as measured over the one of the opposing surfaces of the workpiece, and x is the distance between a integration parameter ds and the edge of the workpiece.

2. The notching tool according to claim 1, wherein the second punch portion protrudes at least 3 mm from the punch plane of the first punch portion.

3. The notching tool according to claim 1, wherein the first punch portion comprises a first lateral edge and the second punch portion comprises a second lateral edge, in such a way that there is a continuous and derivable surface which is common both to a first portion of the first lateral edge and to a second portion of the second lateral edge.

4. A use of a notching tool according to claim 1 in the notching operation of a workpiece, the notching tool comprising a notching punch and a die comprising an inner surface, the notching punch comprising:

a first punch portion with a punch plane, the punch plane being intended to hit the workpiece in a notching operation; and a second punch portion protruding from the punch plane in a direction which is substantially perpendicular to the punch plane, the second punch portion being intended to contact the inner surface of the die when the notching punch hits the workpiece;

the first punch portion having a height $h_{fp}$;

the second punch portion having a height $h_{sp}$ and a yield shear strength $T_{sp}$;

the workpiece having opposing outer surfaces, an edge having a height h, a Poisson's ratio v, an ultimate shear strength $T_{uss}$, and a notching section which takes up a surface $S_{notch}$ in the workpiece and has a lateral surface $S_{lat}$;

the notching operation requiring a force $F_{shear}$ to remove the notching section from the workpiece, and the height of the second punch portion of the punch $h_{sp}$ is greater than h, wherein the second punch portion has an effective surface $S_{sp}$ which is greater than $S_{sp\text{-}min}$, wherein $$S_{sp-min} = \frac{F_X \cdot (h_{fp} + h/2) - M_Y}{(h_{fp} + h_{sp}) \cdot \tau_{sp}}$$

-continued $$M_Y = \int_{S_{lat}} \tau_{USS} \cdot h \cdot (x_p - x) ds$$

$$F_X = \int_{S_{lat}} -v \cdot h \cdot \frac{F_{shear}}{S_{notch}} ds$$

wherein $x_p$ is the distance between the edge of the workpiece and a projection of a center of mass of the first punch portion onto one of the opposing surfaces of the workpiece as measured over the one of the opposing surfaces of the workpiece, and x is the distance between a integration parameter ds and the edge of the workpiece.

5. A method of notching a workpiece by means of a notching tool according to claim 1, the notching tool comprising a notching punch and a die comprising an inner surface, the notching punch comprising:

a first punch portion with a punch plane, the punch plane being intended to hit the workpiece in a notching operation; and a second punch portion protruding from the punch plane in a direction which is substantially perpendicular to the punch plane, the second punch portion being intended to contact the inner surface of the die when the notching punch hits the workpiece;

the method including the steps of:

providing a workpiece for being notched, the workpiece having opposing outer surfaces, an edge having a height h, a Poisson's ratio v, an ultimate shear strength $T_{uss}$, and a notching section which takes up a surface $S_{notch}$ in the workpiece and has a lateral surface $S_{lat}$;

providing the notching tool, the second punch portion having a height $h_{sp}$ and a yield shear strength $T_{sp}$, the height of the second punch portion of the punch $h_{sp}$ being greater than h; and performing a notching operation requiring a force $F_{shear}$ to remove the notching section from the workpiece, and causing a shear stress T in the lateral surface $S_{lat}$ of the notching section, wherein the second punch portion has an effective surface $S_{sp}$ which is greater than $S_{sp\text{-}min}$, wherein $$S_{sp-min} = \frac{F_X \cdot (h_{fp} + h/2) - M_Y}{(h_{fp} + h_{sp}) \cdot \tau_{sp}}$$

$$M_Y = \int_{S_{lat}} \tau_{USS} \cdot h \cdot (x_p - x) ds$$

$$F_X = \int_{S_{lat}} -v \cdot h \cdot \frac{F_{shear}}{s_{notch}} ds$$

wherein $x_p$ is the distance between the edge of the workpiece and a projection of a center of mass of the first punch portion onto one of the opposing surfaces of the workpiece as measured over the one of the opposing surfaces of the workpiece, and x is the distance between an integration parameter ds and the edge of the workpiece.

* * * * *